US007451937B2

(12) United States Patent
Flood et al.

(10) Patent No.: US 7,451,937 B2
(45) Date of Patent: Nov. 18, 2008

(54) THERMOSTAT WITH HANDICAP ACCESS MODE

(75) Inventors: Scott W. Flood, Hopkinton, NH (US); Christopher G. Wanlass, Smithtown, NY (US)

(73) Assignee: Action Talkin Products, LLC, Baltimore, MD (US)

( * ) Notice: Subject to any disclaimer, the term of this patent is extended or adjusted under 35 U.S.C. 154(b) by 622 days.

(21) Appl. No.: 11/180,158

(22) Filed: Jul. 13, 2005

(65) Prior Publication Data

US 2007/0012793 A1 Jan. 18, 2007

(51) Int. Cl.

| | |
|---|---|
| ***G05D 23/00*** | (2006.01) |
| ***F23N 5/20*** | (2006.01) |
| ***G01M 1/38*** | (2006.01) |
| ***G05B 13/00*** | (2006.01) |

(52) U.S. Cl. ..... 236/94; 236/51; 700/276

(58) Field of Classification Search ..... 236/51, 236/94; 165/11.1; 116/205; 700/276, 86
See application file for complete search history.

(56) References Cited

U.S. PATENT DOCUMENTS

2003/0079973 A1* 5/2003 Sun et al. ..... 200/52 R
2003/0144012 A1* 7/2003 Kimura ..... 455/456

* cited by examiner

*Primary Examiner*—Chen-Wen Jiang
(74) *Attorney, Agent, or Firm*—Robert R. Axenfeld; Montgomery, McCracken, Walker & Rhoads LLP

(57) ABSTRACT

An innovative thermostat having a handicap access mode is described. When the handicap access mode is triggered, the thermostat accepts voice commands to control thermostat settings. This innovative thermostat is a particularly convenient feature for the visually impaired, and individuals with limited mobility. In one exemplary embodiment, the thermostat includes a controller operable in a direct input mode and/or a handicap access mode. When in the direct input mode, the controller receives user commands through mechanical actuation of an adjustment mechanism to adjust a thermostat setting. When in the handicap access mode the controller receives voice commands through a microphone to adjust a thermostat setting.

14 Claims, 2 Drawing Sheets

THERMOSTAT WITH HANDICAP ACCESS MODE

TECHNICAL FIELD

The present invention relates generally to thermostats, and more particularly, to thermostats for individuals with disabilities.

BACKGROUND

The regulation of indoor temperature, such as the interior of a home or office, is most commonly monitored and controlled by a thermostat. When an indoor temperature falls below or rises above a desired temperature setting (e.g., a thermostat setting), the thermostat activates a heating/cooling system to warm or cool the indoor temperature to the desired temperature setting.

A thermostat, in its simplest form, must be manually adjusted to change the indoor air temperature. For example, thermostats may be manually activated by turning a knob or positioning a lever to a desired temperature setting, which engages a heating/cooling system to increase or decrease interior temperature if the temperature changes from the desired setting.

More modern thermostats are digitally programmable and can automatically respond to changes in temperature and control heating/cooling in response thereto, to maintain a constant temperature. Most thermostats, whether manual or programmable, have a visible temperature display that shows the current temperature of an area in proximity to the thermostat and the temperature at which the thermostat is set.

Thermostats function in response to changes in ambient temperature in an environment. Therefore, to function properly, a home thermostat is typically located about 5 feet off the ground and about 2 feet away from an outside wall. It should not be exposed to any direct heat sources, such as, sunlight or other heating or cooling appliances. It is also best not to put a thermostat near a staircase or in a corner because they affect the circulation of air.

Because thermostats are for the most part manually operated and because there are limitations as to their placement in the home, challenges arise for certain individuals who may need to operate these important home devices. For example, because thermostats must be positioned high on a wall, they are out of reach for individuals confined to wheelchairs or with impaired mobility. Current thermostat models are also inaccessible to individuals with visual impairments because there is no way to adjust the temperature to the desired setting without the ability to view the temperature display.

There is lacking a thermostat that can be operated by individuals who are physically disabled or limited in their mobility or sight, which allows them the independence to control and achieve a comfortable home climate.

SUMMARY

An innovative thermostat having a handicap access mode is described. The thermostat accepts voice commands when in the handicap access mode. This feature is a particularly useful for the visually impaired, and individuals with limited mobility.

In a described implementation, the thermostat includes a controller operable in a direct input mode and/or a handicap access mode. When in the direct input mode, the controller receives user commands through mechanical actuation of an adjustment mechanism to adjust a thermostat setting. When in the handicap access mode the controller receives voice commands through a microphone to adjust a thermostat setting.

The handicap access mode may be actuated several different ways. In one embodiment, an elevation compensation actuator, directly or indirectly attached to the thermostat, allows a person to actuate the handicap access mode when the person moves the elevation compensation actuator. The elevation compensation actuator may be a flexible cord that when pulled down actuates the handicap mode. Alternatively, the elevation compensation actuator may be a rod that when pushed up, pulled down, or rotated along a longitudinal axis, actuates the handicap mode. The elevation compensation actuator is typically adjusted to compensate for a persons height if they are in a wheel chair or are too short to reach the thermostat on a wall.

In another embodiment, particular audible sounds received by the microphone, in part, trigger the selection of the handicap access mode. For instance, particular clapping patterns, words or phrases, bell sounds, or other audible sounds, when recognized by the thermostat invoke the handicap access mode.

BRIEF DESCRIPTION OF THE DRAWINGS

The detailed description is described with reference to the accompanying figures. In the figures, the left-most digit(s) of a reference number identifies the figure in which the reference number first appears. Reference is now made to the following descriptions taken in conjunction with the accompanying drawings, in which.

DETAILED DESCRIPTION

Exemplary Thermostat with Handicap Access Mode

Figure 1:
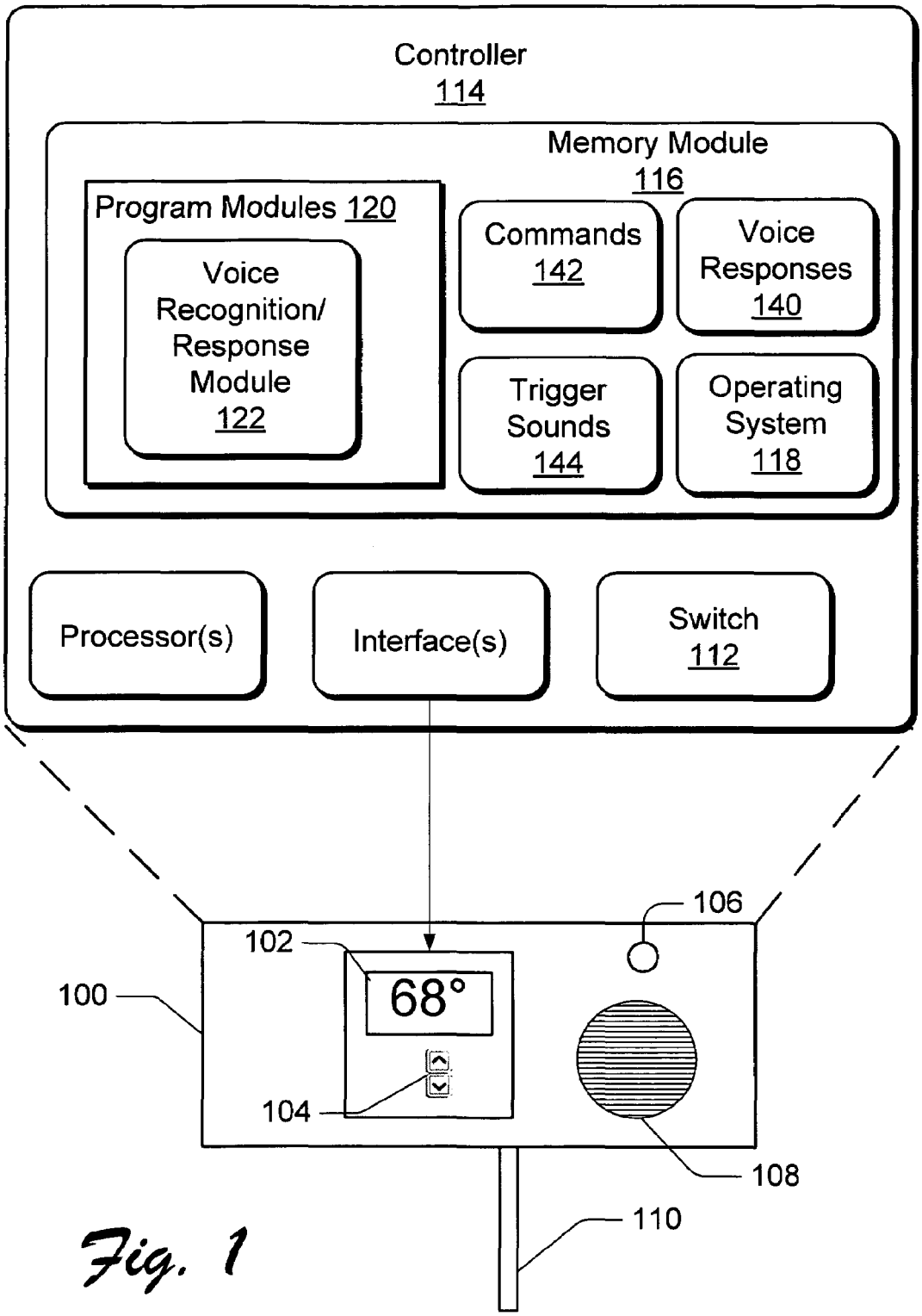
FIG. 1 illustrates various components of an exemplary thermostat that can be utilized to implement the inventive techniques described herein.

FIG. 1 illustrates various components of an exemplary thermostat 100 that can be utilized to implement the inventive techniques described herein. Thermostat 100 utilizes voice recognition technology able to receive and recognize voice commands from an individual to control the operation of the thermostat. Thermostat 100 may also utilize speech response technology providing the ability for thermostat 100 to respond back to an individual verbally (or with other audible tones) in an interactive fashion.

In one implementation, thermostat 100 includes a display panel 102, a manual adjustment mechanism 104, a microphone 106, a speaker 108, an elevation compensation actuator 110, a switch 112, a controller 114, and a memory module 116.

Display panel 102 may enable a user to visually view thermostat settings, such as temperature settings or other programmable settings, such as but not limited to: time, date, temperature history, and average temperature. Display panel 102, may be used by individuals without necessarily having to use voice recognition technology or voice response technology. Display panel 102 may be large enough to enable a person suffering from mild myopia to view content without the aid of corrective lenses. Additionally, magnifying materials (not shown) may be used in conjunction with display panel 102 to enlarge content displayed therein. Various types of display devices, sizes, and shapes may be chosen to implement display panel 102 including the possibility of touch-screen technology. Additionally, display panel may also be implemented with analog display devices. More than one display panel may be included on thermostat 100 and other elements may be used to display information such as audible indicators, lights and LEDs.

Manual adjustment mechanism 104 includes all types of input devices such as a keyboard, buttons, input pads, keypads, or other selectable controls that are manipulated by a user to enter information into thermostat 100. Manual adjustment mechanism 104 may also include dials, levers, and other mechanisms found on thermostats to adjust thermostat settings.

Microphone 106 serves as another mechanism to receive audible information and commands from a user. Microphone 106 may receive voice commands from a user and/or other sounds produced by a user, such as clapping, the ringing of a bell, and other suitable sounds.

A speaker 108 disseminates audio content. The audio content may be in various forms, such as voice and/or tones, and may be disseminated to a user in conjunction with visual content on display panel 102.

An elevation compensation actuator 110 may also be used in connection with thermostat 100. An elevation compensation actuator 110 may include a pull cord, a rod, a remote activation device such as wireless device, and other suitable devices. In the form of a flexible cord or rod the elevation compensation actuator 110 is typically attached directly (as shown in FIG. 1) (although not required) to thermostat 100 and adjusted to hang down from thermostat 100 to compensate for an individual's height if the individual is in a wheel chair or is too short to reach thermostat 100 on a wall. By moving elevation compensation actuator 110 an individual triggers a switch (shown as block 112), which in turn, communicates with controller 114 (to be described), and activates a handicap access mode for thermostat 100. As shall be explained, the handicap access mode facilitates a mode of operation for communicating with thermostat 100 in an interactive fashion, in which commands may be conveyed to and/or received from the thermostat 100 in an audible fashion.

When elevation compensation actuator 110 is implemented as a flexible cord, an individual may simply pull-down on the cord to activate switch 112, and in turn, the handicap mode of operation. When elevation compensation actuator 110 is implemented as a rod, an individual may activate switch 112 by simply pushing up on the rod, pulling down on the rod, or rotating it along its longitudinal axis. It is also possible to implement elevation compensation actuator 110 as a remote device that is able to communicate with thermostat 100.

Controller 114 processes various instructions to control the operation of thermostat 100, and may communicate with other electronic and computing devices. Controller 114 may be implemented as one or more processors, microcontrollers, circuitry, logic, a combination of the aforementioned, or other computational resources configured to perform operational acts described herein.

Memory module 116 may include one or more memory components, examples of which include volatile memory (e.g., a random access memory (RAM) and the like), and a non-volatile memory (e.g., ROM, Flash, EPROM, EEPROM, a hard disk drive, any type of magnetic or optical storage device, and the like). The one or more memory components store computer-executable instructions in the form of program applications, routines, logic, modules and other applications. Additionally, various forms of information and/or data can be stored in volatile or non-volatile memory.

Alternative implementations of controller 114 and memory module 116 can include a range of processing and memory capabilities, and may include any number of memory components other than those illustrated in FIG. 1. For example, full-resource thermostats can be implemented with substantial memory and processing resources, or low-resource thermostats can be implemented with limited processing and memory capabilities.

An operating system 118, such as Windows® CE operating system from Microsoft® Corporation or other operating systems, and one or more program modules 120 may be resident in memory module 116 and execute on processor(s) (part of controller 114) to provide a runtime environment. A runtime environment facilitates extensibility of thermostat 100 by allowing various interfaces to be defined that, in turn, allow program modules 120 to interact with controller 114. The program modules 120 can include off-the-shelf programs modules, or may be tailored programs.

Program modules 120 can also include one or more other programs configured to provide thermostat specific user interfaces including menus and information directed to users of thermostat 100. These menus and information may be conveyed to a user in the form of display panel 102 and/or audibly through speaker 108. For example, a voice recognition/response module 122, generally facilitates operational aspects of thermostat to enable receipt of commands from an individual in an audible fashion. Voice recognition/response module 122 also enables conveyance of audible information to an individual in response to commands (including requests) made by the individual. For example, recognition/response module 122 may select one or more voice responses 140 from memory module 116 in response to commands received from a user of thermostat 100.

Voice recognition/response module 122 may be implemented using rudimentary voice recognition technology or more sophisticated technology, such as a training mode to learn voice command patterns. For example, in a training mode a user can tailor a list of predefined commands in the user's own voice. Voice recognition/response module 122 may save the specific commands 142 pronounced by the voice of a user in memory module 116 and/or the commands 142 may be predefined without the need for user input.

Handicap access mode may be triggered several different ways. As described above, elevation compensation actuator 110 may be used to activate the handicap access mode, and the launching of voice recognition/response module 122.

Handicap access mode may also be triggered (e.g. selected), when thermostat 100 receives particular audible sounds from microphone 106. That is, microphone 106 receives certain volume sounds and transmits them to controller 114. Voice recognition/response module 122, analyzes the received sounds and determines whether they match one or more sound patterns stored in memory module 116 associated with activating the handicap access mode (referred to as Trigger Sounds 144). The particular audible sounds may be predetermined and saved in memory module 116 or saved by the user. Examples of particular audible sounds that may trigger the handicap access mode include, but are not limited to, one or more of a series of hand claps, a particular word, a phrase, a ringing of a bell, a blowing of a horn, or various other tones.

Once the system is trained (or if the system has pre-saved verbal commands), a user can launch the handicap access mode by emitting a particular trigger sound 144. Once the handicap access mode is activated, a user can issue a verbal command to thermostat 100, to change system settings associated with heating or air-conditioning, or program the thermostat. For example, assuming the handicap access mode is selected, a user may issue a request such as, "what is the temperature?"

Voice synthesizing technology may be included as part of Voice recognition/response module 122 to convey verbal information and sounds from the thermostat to an individual. So in response to the temperature question, voice recognition/response module 122 may convey an answer, such as "it is 68 degrees." Again, the responses may be selected from a set of potential voice responses 140 stored in memory module 116.

Although not shown in FIG. 1, it is appreciated that voice recognition/response module 122 and controller 114 may utilize well known filters, and A/D converter technology to convert information received from microphone 106 into a digital format for processing by controller 114, or to convert information into an analog format from the controller 114, for transmission to a user via speaker 108. Additionally, although not shown, a system bus as well as other well known interconnect technology may be used to connect the various components within thermostat 100.

It is also noted that program modules 120, such as voice recognition/response module 122, may execute on processor(s) or other computational devices, and can be stored as computer-executable instructions in memory module 116. Although the program modules 120 are illustrated and described as single applications or module(s), each can be implemented as one or more combined components. For purposes of illustration, programs, modules and other executable program or logical components are illustrated herein as discrete blocks, although it is recognized that such programs and components reside at various times in different storage components and may be executed by one or more processors that are not necessarily part of thermostat 100.

It is to be appreciated that additional components (not shown) can be included in thermostat 100 and some components illustrated in thermostat 100 above need not be included. For example, additional processors or storage devices, additional interfaces, and so forth may be included in thermostat 100, or a display panel may not be included.

It is also to be appreciated that the components and processes described herein can be implemented in software, firmware, hardware, or combinations thereof. By way of example, a programmable logic device (PLD) or application specific integrated circuit (ASIC) could be configured or designed to implement various components and/or processes discussed herein.

Exemplary Methods of Operation

Methods of operation for thermostat 100 may be described in the general context of computer-executable instructions. Generally, computer-executable instructions include routines, logic, programs, objects, components, data structures, etc. and the like that perform particular functions or implement particular abstract data types. The described method may also be practiced in distributed computing environments where functions are performed by remote processing devices that are linked through a communications network. In a distributed computing environment, computer-executable instructions may be located in both local and remote storage media, including memory storage devices.

Figure 2:
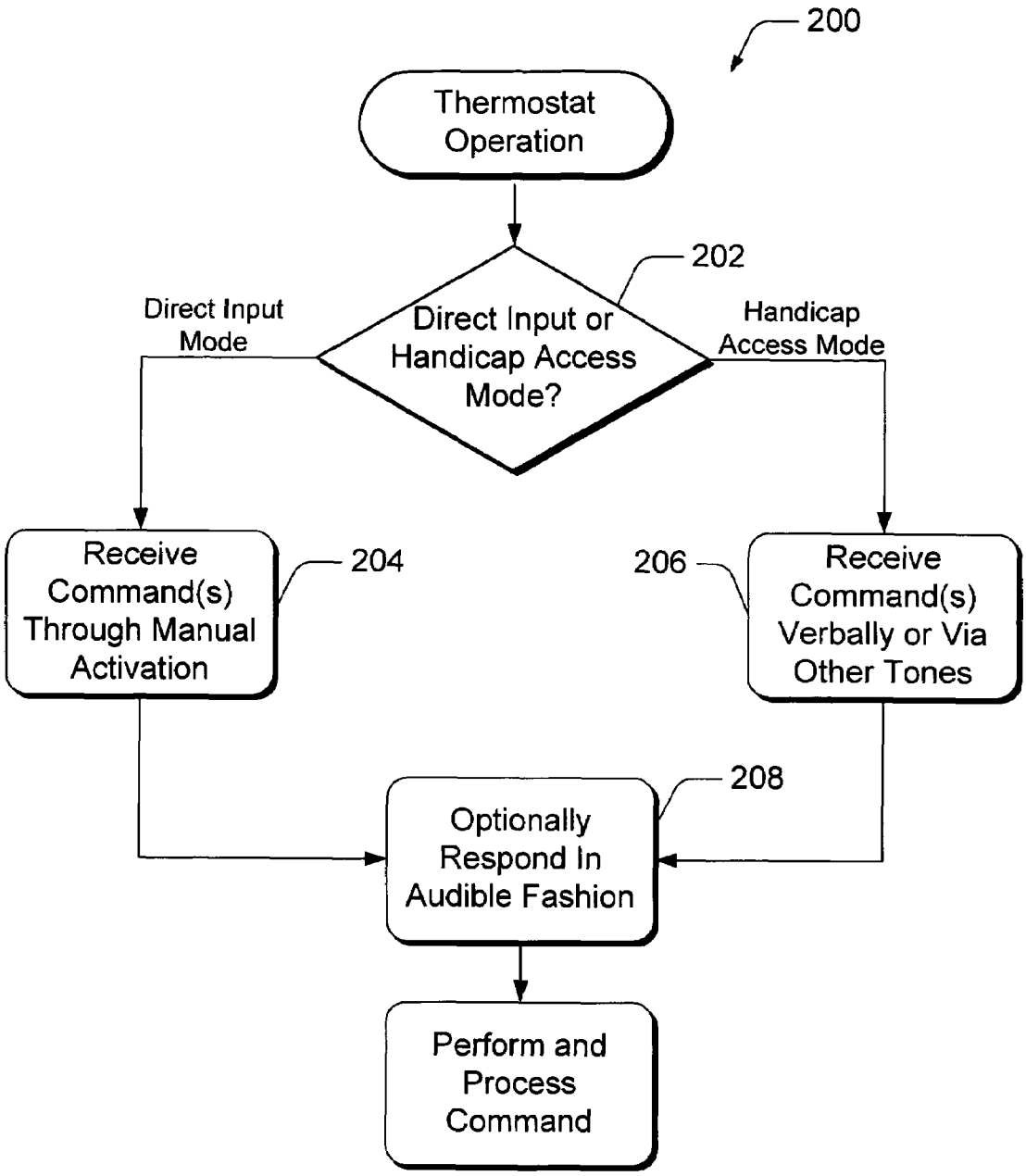
FIG. 2 is a flow diagram that illustrates an exemplary method of operation that may be used with the innovative thermostat described in FIG. 1.

FIG. 2 is a flow diagram that illustrates an exemplary method 200 of operation associated with thermostat 100. The order in which the method is described is not intended to be construed as a limitation, and any number of the described method blocks can be combined in any order to implement the method. Each of the operations and blocks may be optional and do not necessarily have to be implemented. Furthermore, the method can be implemented in any suitable hardware, software, firmware, logic, or combination thereof. Exemplary method 200 includes blocks 202 through 208.

In block 202, a determination is made whether a direct-input-mode or handicap access mode is selected (e.g., triggered). The direct input mode may be triggered when a user attempts to adjust a thermostat setting by directly touching a manual adjustment mechanism, such as a manual adjustment mechanism 104 (FIG. 1).

The handicap access mode may be triggered several different ways. For instance, the triggering impetus may be received from movement of an elevation compensation actuator 110 (FIG. 1) in communication with the thermostat's controller 114 (FIG. 1). For example, a user may pull down on a pull-cord which enables a switch 112 (FIG. 1) to send an activation signal to controller 114, thereby selecting a handicap access mode of operation.

The triggering impetus may also be received in the form of a sound, such as a key word, phrase, clap(s), bell, horn, etc. For example, microphone 106 receives sounds and sends them to controller 114. Voice recognition/response module 122 (FIG. 1) in conjunction with controller 114, analyzes the received sounds and determines whether they match one of a set of sound patterns stored in memory module 116 associated with activating the handicap access mode.

Once a determination is made in block 202 whether the direct input mode or handicap access mode is selected, process 200 proceeds to either block 204 or 206. For instance, if the direct input mode is selected in block 202, process 200 proceeds to block 204. If the handicap access mode is selected in block 202, process 200 proceeds to block 206.

In block 204, the direct input mode is activated and thermostat receives commands through one or more manual adjustment mechanisms.

In block 206 the handicap access mode is activated. At this point, voice recognition/response module 122 (FIG. 1) in conjunction with controller 114, listen for a command to adjust a thermostat setting which includes responding to requests for information, such as the current temperature setting, the temperature in a room, and so forth. For example, a command, such as "set the heater to 68 degrees" is received by microphone 106 and converted into a digital format and compared with a list of stored commands in memory module 116.

In block 208, it is possible for the thermostat to reply to the use in an interactive fashion each time it receives requests or commands using speaker 108. If the controller 114 and voice recognition/response module 122 (FIG. 1) do not recognize a command, the thermostat may prompt the user to repeat the command or query the user with yes/no questions to determine what the user was attempting to say. Additionally, at any point in process 200, thermostat may transmit audio responses through speaker 108 back to the user, even if the user is using the direct input mode of operation. For examples of how the thermostat may provide audible outputs, please see U.S. Pat. No. 5,690,277 entitled Audible Thermostat to Flood, incorporated herein by reference.

In block 210, controller 114 uses the command(s) received in either direct input mode or handicap access mode to invoke an action such as sending a signal to a increase/decrease heating, or some other suitable action, such as changing a temperature setting, a program setting (such as program interval heating/cooling periods), setting a time setting and so forth.

It is noted that whether in the direct input mode or handicap access mode, a timer is typically set for allowing a maximum time to receive commands either through a mechanical adjustment mechanism 104 (FIG. 1) or through voice commands or other tones. If the thermostat does not receive the commands within a predetermined time period, the thermostat "times out" (i.e., resets) and process 200 returns back to block 202. For example, controller 114 allows the user to perform any number of supported actions using the display panel 102 (FIG. 1) and/or mechanical adjustment mechanism 104 (FIG. 1) within a predetermined period of time. Otherwise, process 200 will reset. Likewise, if the thermostat does not receive audible commands within the predetermined time period, the thermostat "times out" (i.e., resets) and process 200 returns back to block 202.

Additionally, at any point in process 200, thermostat 100 allows for manual intervention through display panel 102 or manual adjustment mechanism 104.

The described embodiments are to be considered in all respects only as exemplary and not restrictive. The scope of the invention is, therefore, indicated by the appended claims rather by the foregoing description. All changes which come within the meaning and range of equivalency of the claims are to be embraced within their scope.

What is claimed is:

1. A thermostat, comprising:

a controller operable in a selectable one of: a direct input mode in which the controller receives user commands through a mechanical actuation of an adjustment mechanism to adjust a thermostat setting; and a handicap access mode in which the controller receives voice commands through a microphone to adjust a thermostat setting;

a switch in communication with the controller; and an elevation compensation actuator attached to the switch, wherein the elevation compensation actuator, in part, triggers the selection of the handicap access mode when a person moves the elevation compensation actuator.

2. The thermostat as recited in claim 1, wherein the elevation compensation actuator is at least one of a cord and a rod.

3. The thermostat as recited in claim 1, wherein the microphone is in communication with the controller, and is adapted to receive audible sounds, wherein when particular audible sounds are received by the microphone, the particular audible sounds, in part, trigger the selection of the handicap access mode.

4. The thermostat as recited in claim 1, wherein the microphone is in communication with the controller, and is adapted to receive audible sounds, wherein when particular audible sounds are received by the microphone, the particular audible sounds, in part, trigger the selection of the handicap access mode, and wherein the particular audible sounds include at least one of a clap, a particular word, a particular phrase, a ringing sound, and a horn sound.

5. The thermostat as recited in claim 1, wherein a thermostat setting includes at least one of temperature selling and a time setting.

6. A thermostat comprising: a microphone adapted to receive audible sounds, a controller, a switch in communication with the controller, and an elevation compensation actuator attached to the switch, wherein movement of the elevation compensation actuator causes the switch to send a signal to the controller.

7. The thermostat as recited in claim 6, wherein the elevation compensation actuator is at least one of a cord and rod.

8. The thermostat as recited in claim 6, wherein the elevation compensation actuator is in a position easily accessible by a person in a wheel chair.

9. The thermostat as recited in claim 6, wherein the microphone is connected to the controller, and is adapted to transmit the audible sounds in the form of signals to the controller, the audible sounds including voice commands to adjust settings associated with controlling the thermostat.

10. A thermostat, comprising: a controller operable in a selectable one of: a direct input mode in which the controller receives user commands through a touch keypad to adjust a thermostat setting; and a handicap access mode in which the controller receives user commands to adjust a thermostat setting by receiving voice commands;

a switch in communication with the controller; and a pull cord attached to the switch, whereby pulling on the pull cord, in part, triggers the selection of the handicap access mode through activation of the switch.

11. The thermostat as recited in claim 10, wherein a thermostat selling includes a programmable setting associated with controlling ambient temperature.

12. The thermostat as recited in claim 10, further comprising a microphone in electrical communication with the controller, the microphone adapted to receive audible sounds, wherein when particular audible sounds are received by the microphone, the particular audible sounds, in part, trigger the selection of the handicap access mode.

13. The thermostat as recited in claim 10, further comprising a microphone in electrical communication with the controller, the microphone adapted to receive audible sounds, wherein when particular audible sounds are received by the microphone, the particular audible sounds, in part, trigger the selection of the handicap access mode, and wherein the particular audible sounds include at least one of a clapping sound, a particular word, and a particular phrase.

14. The thermostat as recited in claim 10, wherein a thermostat setting includes at least one of a temperature setting and a time setting.

* * * * *